US007350598B2

(12) United States Patent
Booth

(10) Patent No.: US 7,350,598 B2
(45) Date of Patent: Apr. 1, 2008

(54) DOWNHOLE TOOL

(75) Inventor: Richard Keith Booth, Isle of Man (GB)

(73) Assignee: Hamdeem Incorporated Ltd., Laxey, Isle of Man (GB)

( * ) Notice: Subject to any disclaimer, the term of this patent is extended or adjusted under 35 U.S.C. 154(b) by 315 days.

(21) Appl. No.: 11/182,441

(22) Filed: Jul. 15, 2005

(65) Prior Publication Data

US 2006/0011389 A1 Jan. 19, 2006

(51) Int. Cl.
*E21B 21/10* (2006.01)

(52) U.S. Cl. ..... 175/317; 166/331; 175/324

(58) Field of Classification Search ..... 175/317, 175/324; 166/330, 331
See application file for complete search history.

(56) References Cited

U.S. PATENT DOCUMENTS 1,785,086 A * 12/1930 Hauk ..... 175/317
2,569,732 A * 10/1951 Ragan ..... 166/330
2,675,875 A * 4/1954 Potts ..... 166/330
2,865,608 A * 12/1958 McKenna ..... 175/317
4,909,326 A * 3/1990 Owen ..... 166/317

FOREIGN PATENT DOCUMENTS

| | | | |
|---|---|---|---|
| EP | 1 055 797 | A3 | 10/2002 |
| EP | 0 969 181 | A3 | 3/2003 |
| WO | WO 2004/097165 | A1 | 11/2004 |
| WO | WO 2005/003508 | A1 | 1/2005 |

* cited by examiner

*Primary Examiner*—Hoang Dang
(74) *Attorney, Agent, or Firm*—Drinker, Biddle & Reath

(57) ABSTRACT

A downhole tool for use within a well comprising a body having an external diameter smaller than the diameter of the well so as to form an annular gap between the body and the interior surface of the well. A first downhole fluid passage having an upper inlet and a lower outlet is provided in the body. At least one secondary fluid passage extending between the first downhole fluid passage and the annular gap is provided at the body. A sleeve member is provided at the body and adapted to move between a first position in which said at least one secondary fluid passage is closed and a second position in which said at least one secondary fluid passage is open. The sleeve member is maintained at one or both of the first and second positions upon rotation of the body within the well.

52 Claims, 10 Drawing Sheets

DOWNHOLE TOOL

The present invention relates to a downhole tool. In particular, but not exclusively, the invention relates to downhole circulation sub-assemblies for drill strings.

During oil and gas extraction, the well is lined using casing which comprises a number of steel pipes, typically each having a length of 10 meters, which are connected together as they are run into the well then cemented in place. A number of stabilisers form part of the drill string, each having external fins or blades which are often spiral in formation. The fins contact the casing or borehole wall to provide rigidity and maintain alignment of the drill bit.

During normal operation of the drill string, the drill bit is rotated in a clock-wise direction. At the same time, drilling mud is pumped down from the surface within the drill string to ports, commonly known as jets, provided at the drill bit. The mud then returns to the surface via the annular gap between the drill string and the internal surface of the well, clearing and carrying drill cuttings which are formed from the drilling process.

It is desirable for a number of reasons that flow ports can be selectively opened or closed at a location other than the drill bit. Once drilling of a section is complete it is desirable to selectively open additional ports in order to increase the flow rate of mud being pumped into the string, which provides a resultant increase in fluid velocity in the annulus. This increase in annular velocity will assist with the efficient removal of drill cuttings from the well.

When the drill string is being pulled out of the well, the mud in the string is allowed to exit the string from a location other than the jets. When pulling out, no pumping pressure is applied and the flow rate from the drill bit jets is relatively low. Increasing the flow rate can improve drainage of the string, particularly when there is a downhole drill motor, or similar flow restriction in the string. However, any alternative exit ports provided must be closed during normal operation of the drill string and preferably when the string is being run into the well.

There are occasions, such as when back-reaming a drilled section of the well, that the alternative exit ports should remain closed when the tool is being lifted within the well in order to minimise the risk of differential sticking. Differential sticking of the drill string happens when the drill string becomes adhered to the borehole wall due to the difference in pressure between the hydrostatic pressure of the column of well fluid and the pore pressure of the rock being drilled. It is advantageous to provide means for selectively maintaining closure of the ports as the tool is moved relative to the well.

Existing means for opening and closing exit ports when the drill string is in the well suffer from a number of disadvantages. A common method of opening the ports is to drop a ball down the drill string to open a suitably adapted valve. However, closing the valve or repeated operation of the valve is problematic and time consuming.

WO 02/081858 discloses a filtering and scraping tool which includes a sleeve valve positioned near the lower end of the drill string. The sleeve includes drag blocks for contacting the casing of the well. During run in, the tool moves downwards relative to the casing and, due to frictional contact with the casing, the sleeve moves upwards relative to the tool, thus closing the valve. The valve remains closed during operation of the drill string. During run out, the tool moves upwards relative to the casing and so the sleeve moves downwards relative to the tool, thus opening the valve. This tool performs reliably in a cased well. However, it is unlikely to survive the rigours of the open hole drilling process as this design is intended for cased hole work only.

According to a first aspect of the invention there is provided a downhole tool for use within a well, comprising:

- a body having an external diameter smaller than the diameter of the well so as to form an annular gap between the body and the interior surface of the well;
- a first downhole fluid passage provided in the body and having an upper inlet and a lower outlet;
- at least one secondary fluid passage provided at the body and extending between the first downhole fluid passage and the annular gap; and
- a sleeve member provided at the body and adapted to move between a first position in which said at least one secondary fluid passage is closed and a second position in which said at least one secondary fluid passage is open; and
- retention means which maintains the sleeve member at one or both of the first and second positions upon rotation of the body within the well.

Preferably the retention means is adapted to maintain the sleeve member at one or both of the first and second positions when the rate of rotation is above a predetermined value or range of values. Preferably the predetermined value is in the range of 20 to 40 revolutions per minute.

Preferably the sleeve member is slideably mounted at the body. The sleeve member may be externally or internally mounted at the body.

Preferably the body and the sleeve member have co-operating engagement means for maintaining the sleeve member at one or both of the first and second positions.

In accordance with a first embodiment of the invention, preferably rotation of the body causes the sleeve member to move to, and thereafter be maintained at, the first position. Preferably the co-operating engagement means is such that rotation of the body produces a force to move the sleeve member to the first position. Preferably the engagement means comprises a cam member provided at the body and a cam follower provided at the sleeve and the force produced is a translational force. Preferably the force is a translational force in the direction of the longitudinal axis of the body. Alternatively, the force is a rotational force. Preferably a stop is provided to prevent movement of the sleeve member beyond the first position.

Preferably the sleeve member is rotatably mounted to the body. Preferably the sleeve member rotates relative to the body when the sleeve member is in the second position. Preferably the sleeve member rotates relative to the body when the sleeve member is between the first and second position.

Preferably the rotation of the sleeve member and the body are coupled when the sleeve member is in the first position.

Preferably the sleeve member is arranged such that movement of the tool downwardly relative to the well urges the sleeve member to the first position. Preferably the sleeve member is arranged such that movement of the tool upwardly relative to the well urges the sleeve member to the second position. Preferably the sleeve member is urgeable to the second position when the tool moves upwardly relative to the well due to one or both of gravity and frictional contact between the protrusions and the well.

In accordance with a second embodiment of the invention, preferably the co-operating engagement means comprises a key member receivable within a first recess. Preferably the sleeve member is maintained at the first position when the key member is within the first recess. Preferably the key member is provided at the body and the first recess is provided at the sleeve. Preferably the key member is horizontally aligned with the first recess when the sleeve member is at the first position.

Preferably the key member and the first recess have a complementary profile. Preferably the profile is semi-circular. Preferably the first recess is provided with a relief portion. The relief portion assists movement of the key member out of the recess when the body is not being rotated.

Preferably the co-operating engagement means includes a second recess. Preferably the sleeve member is maintained at the second position when the key member is within the second recess. Preferably the second recess has a profile which is substantially the same as the first recess. Preferably the second recess is provided with a relief portion. Preferably the key member is horizontally aligned with the second recess when the sleeve member is at the second position.

Preferably the sleeve member is arranged such that movement of the tool downwardly relative to the well urges the sleeve member to the first position unless the sleeve member is being maintained at the second position. Preferably the sleeve member is arranged such that movement of the tool upwardly relative to the well urges the sleeve member to the second position unless the sleeve member is being maintained at the first position. Preferably the sleeve member is urgeable to the second position when the tool moves upwardly relative to the well due to one or both of gravity and frictional contact between the protrusions and the well.

In accordance with a third embodiment of the invention, preferably the co-operating engagement means includes a second key member receivable within a third recess. Preferably the second key member comprises a pin provided at the sleeve member. Preferably the sleeve member is maintained at the second position when the second key member is within the third recess. Preferably the third recess is provided with a relief portion.

The co-operating engagement means includes a fourth recess. The fourth recess may be provided with a relief portion.

Preferably one or more of the recesses and the key members are provided at an internal surface of the sleeve member. The sleeve member houses the recesses and the key members to protect them from damage and to inhibit the ingress of solids.

Preferably the co-operating engagement means is arranged such that, in use, one but not both of the first and second key members bears a rotational load.

Preferably the co-operating engagement means is adapted such that the sleeve member is maintained at one or both of the first and second positions when the rate of rotation is above a predetermined value or range of values. Preferably the predetermined value is at least partially determined by the presence of the relief portion. Preferably the predetermined value is at least partially determined by the geometry of the relief portion. Preferably the predetermined value is at least partially determined by the geometry of one or more of the recesses. Preferably the predetermined value is at least partially determined by the geometry of one or both of the key members.

Preferably the downhole tool includes locking means for locking the sleeve member at one of the first and second positions. Preferably the locking means comprises one or more locking pistons. Preferably the or each locking piston is actuatable by the fluid pumping pressure.

In accordance with the first, second or third embodiment of the invention, preferably the downhole tool includes one or more stops for preventing movement of the sleeve member beyond one or both of the first and second positions. Preferably the or each stop is further adapted to bear an axial load during use of the downhole tool.

Preferably the sleeve member includes one or more protrusions extending from the body of the sleeve member and contacting the interior surface of the well. Preferably frictional contact between the protrusions and the well causes the sleeve member to be urged to the first position when the tool moves downwardly relative to the well.

Preferably the tool includes connecting means for connecting the tool to a drill string. Preferably the sleeve member comprises a stabiliser.

Preferably the drill string includes a drill bit having one or more exit ports extending between the first downhole fluid passage and the annular gap, and at least one orifice of the secondary fluid passage is smaller than at least one orifice of the or each exit port. Alternatively or in addition, the tool may include a valve having an open position in which fluid may flow to the or each exit port and a closed position in which fluid is prevented from flowing to the or each exit port. The valve may be adapted to open when the fluid pumping pressure exceeds a predetermined value. The valve may include biasing means to close the valve when the fluid pumping pressure is below a predetermined value.

Preferably the tool includes a plurality of secondary fluid passages. Preferably the tool includes four secondary fluid passages arranged substantially radially about the first body member. The sleeve member may comprise sealing means to ensure that the passages are sealedly closed when the sleeve member is in the first position.

Embodiments of the present invention will now be described, by way of example only, with reference to the accompanying drawings, in which.

Figure 5:
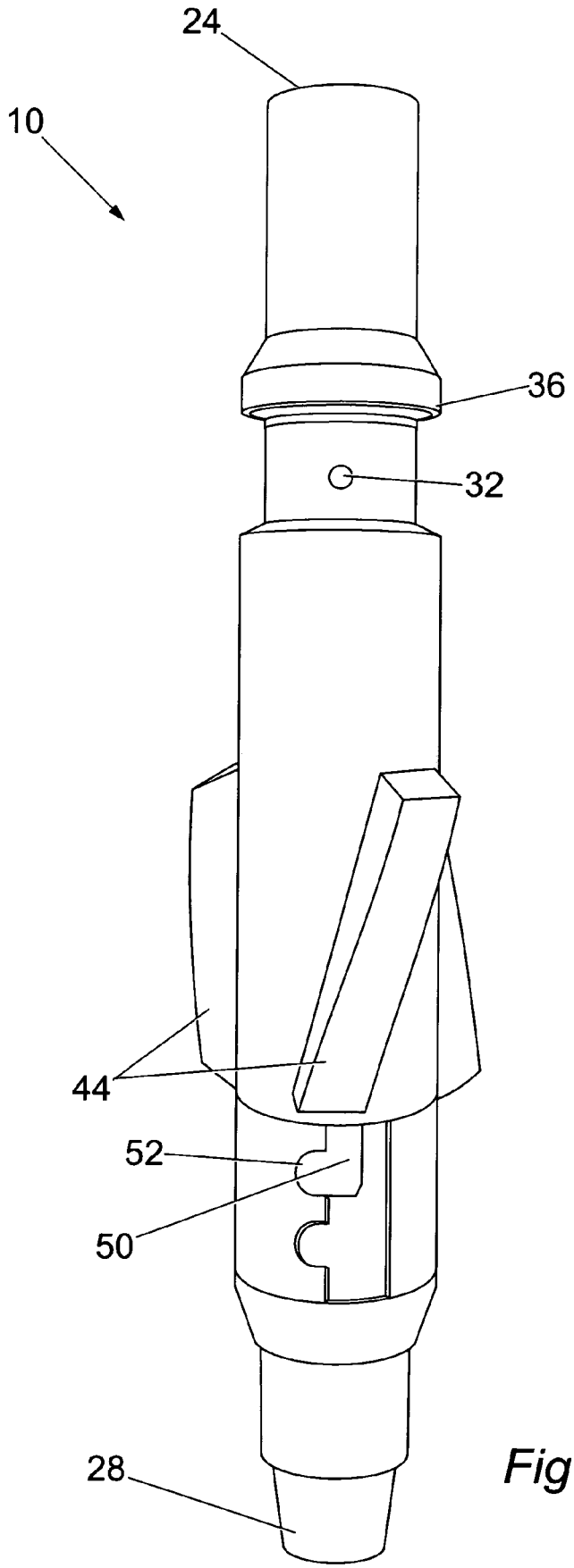
FIG. 5 is a front view of a tool according to a second embodiment of the invention.
Figure 6:
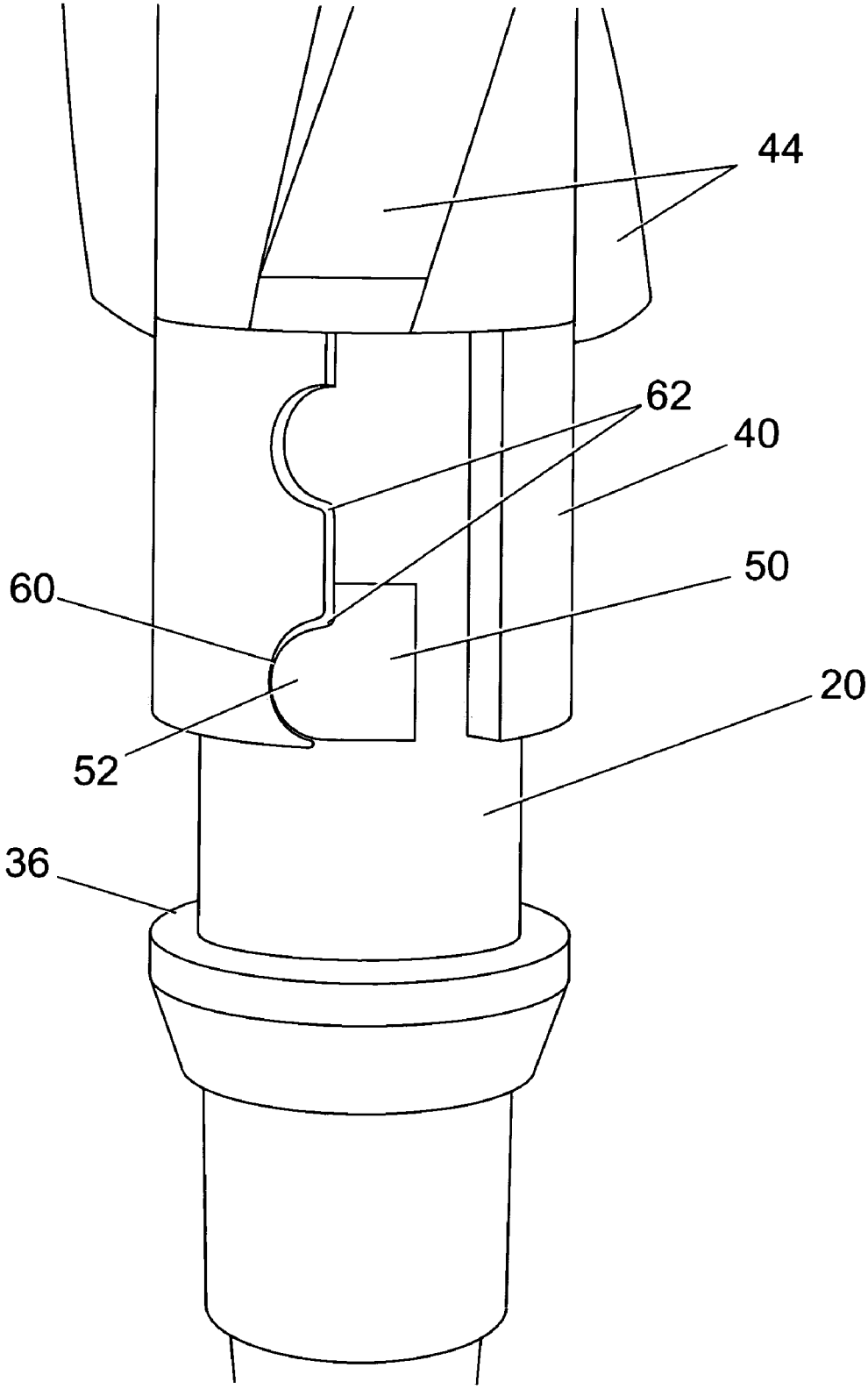
FIG. 6 is a front view of a portion of the tool of FIG. 5 with the sleeve in a first position.
Figure 7:
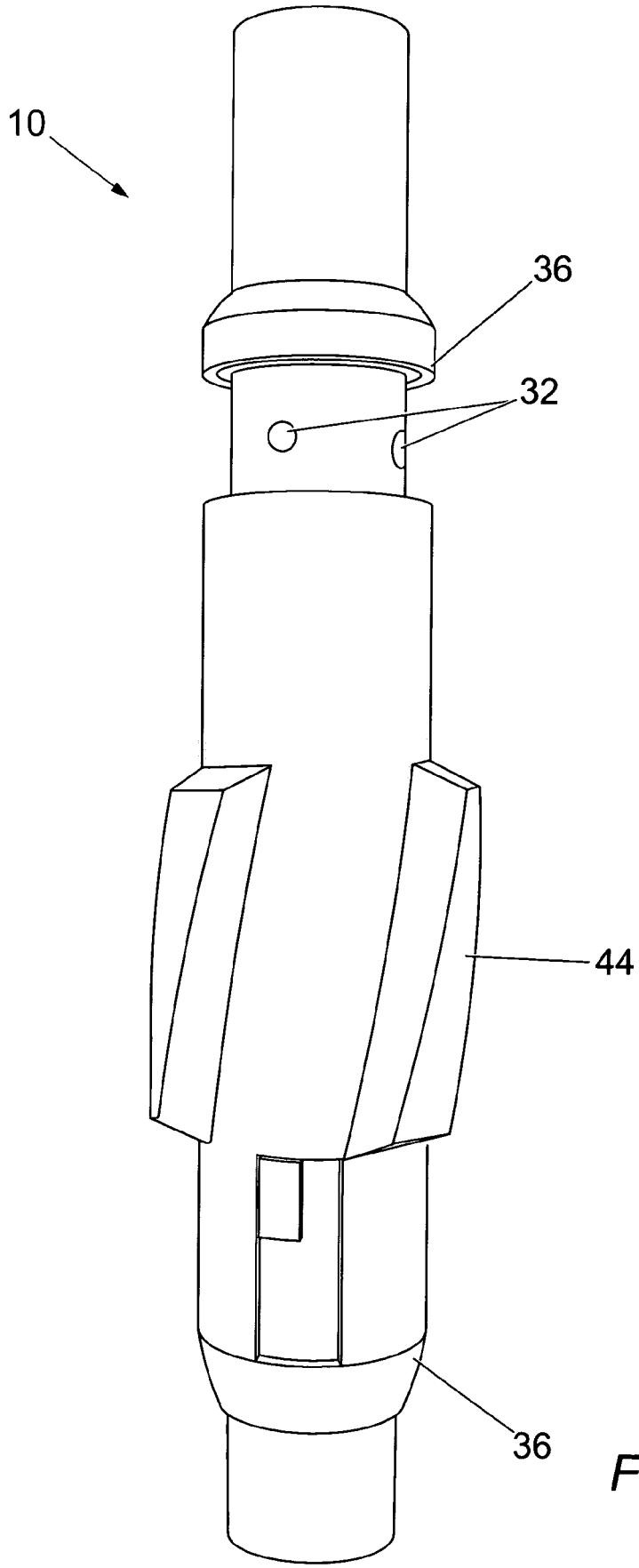
FIG. 7 is a rear view of the tool of FIG. 5.
Figure 8D:
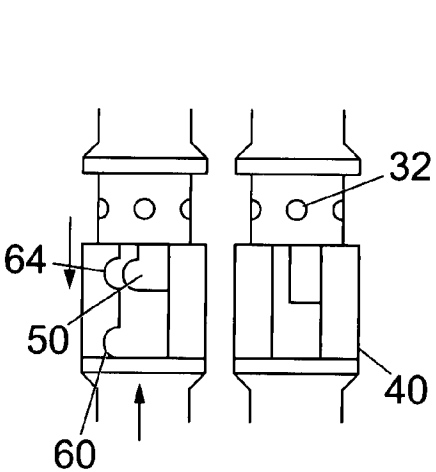
Figure 8C:
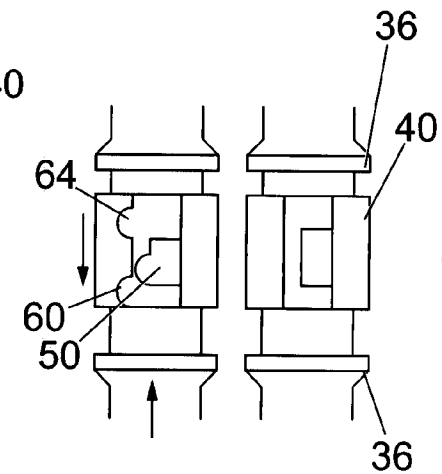
Figure 8B:
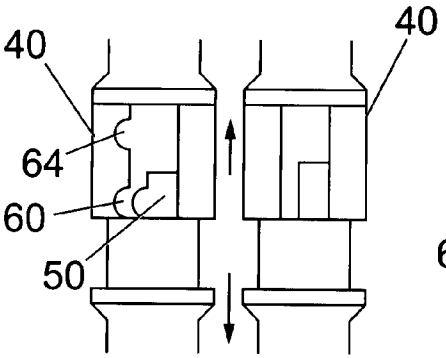
Figure 8A:
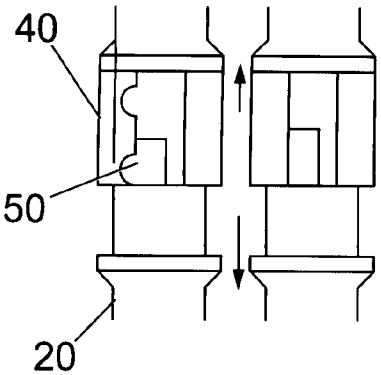
Figure 9A:
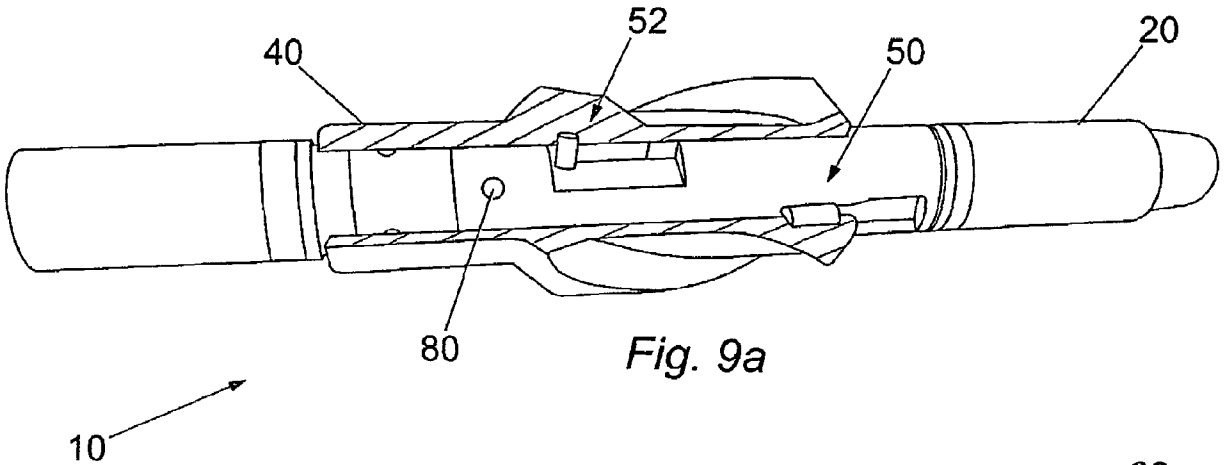
Figure 9B:
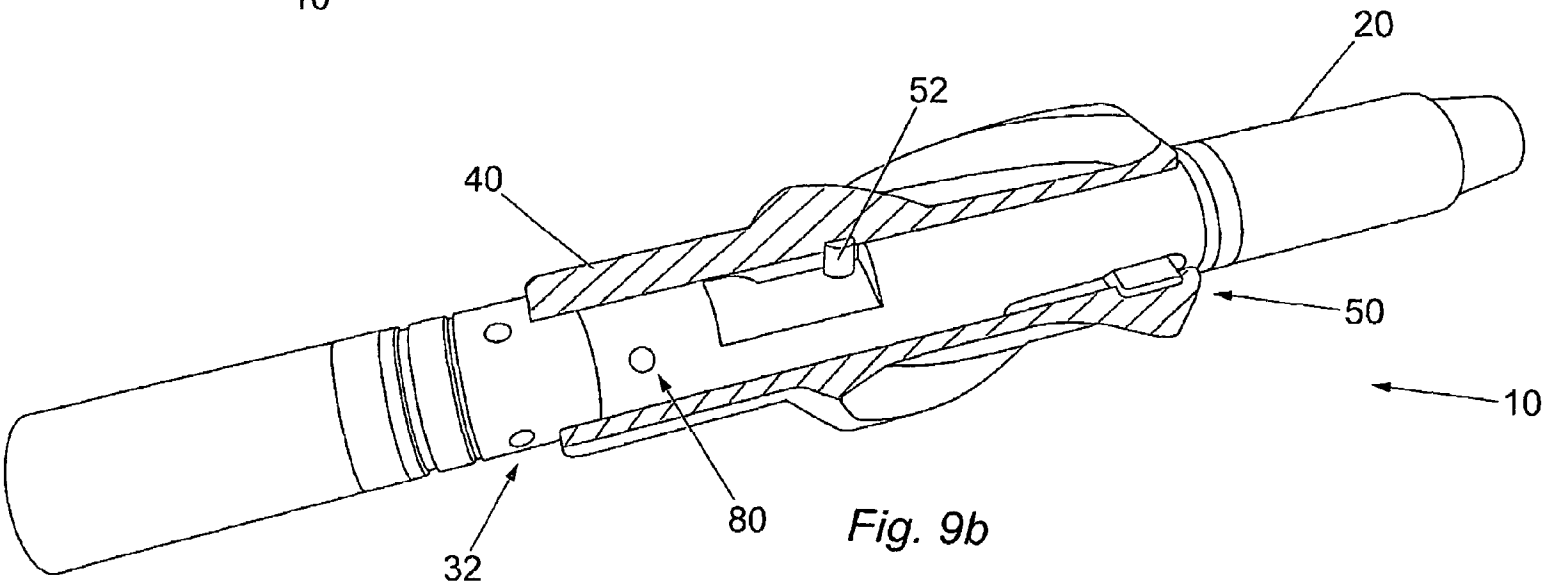
Figure 10A:
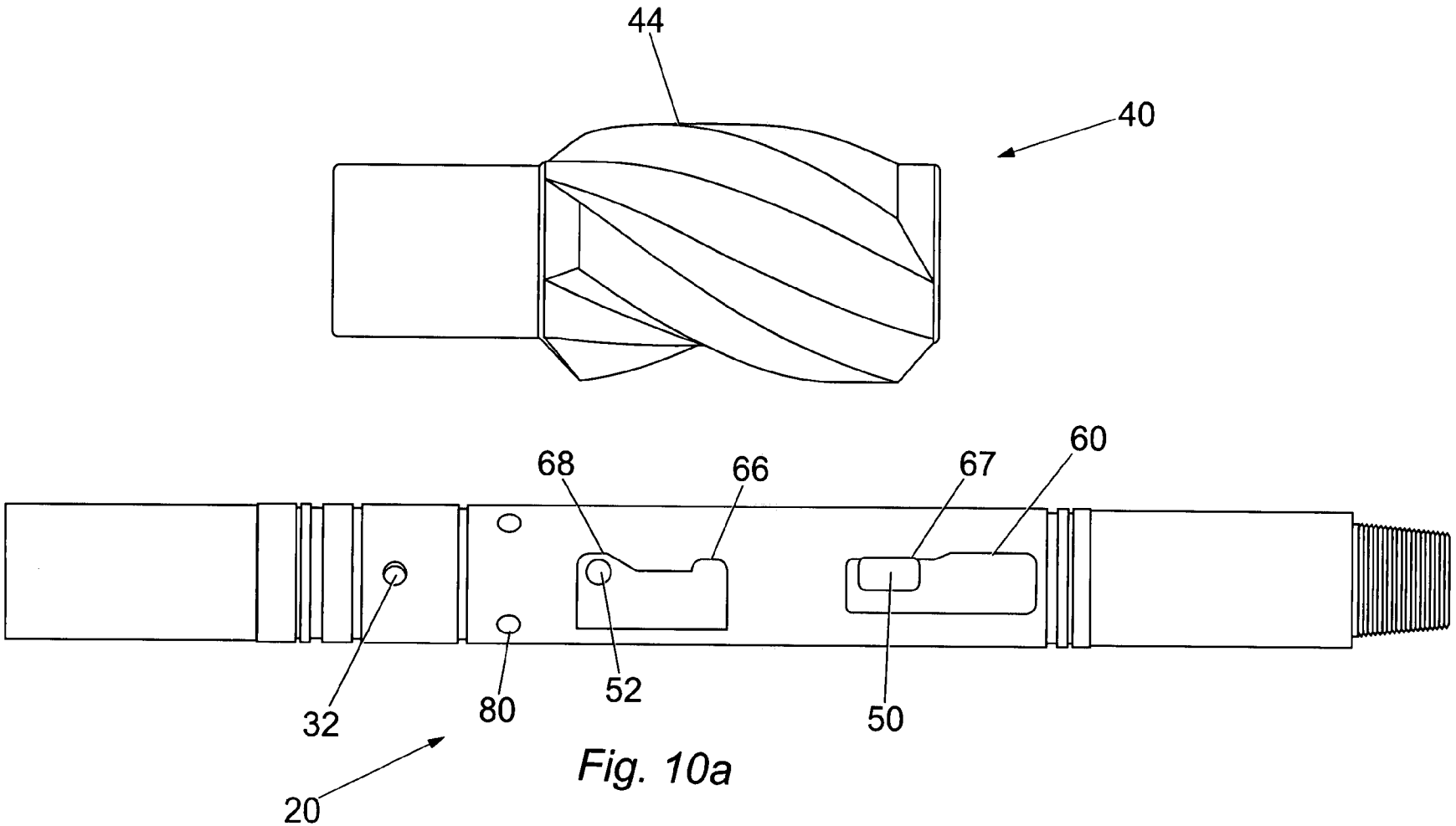
Figure 10B:
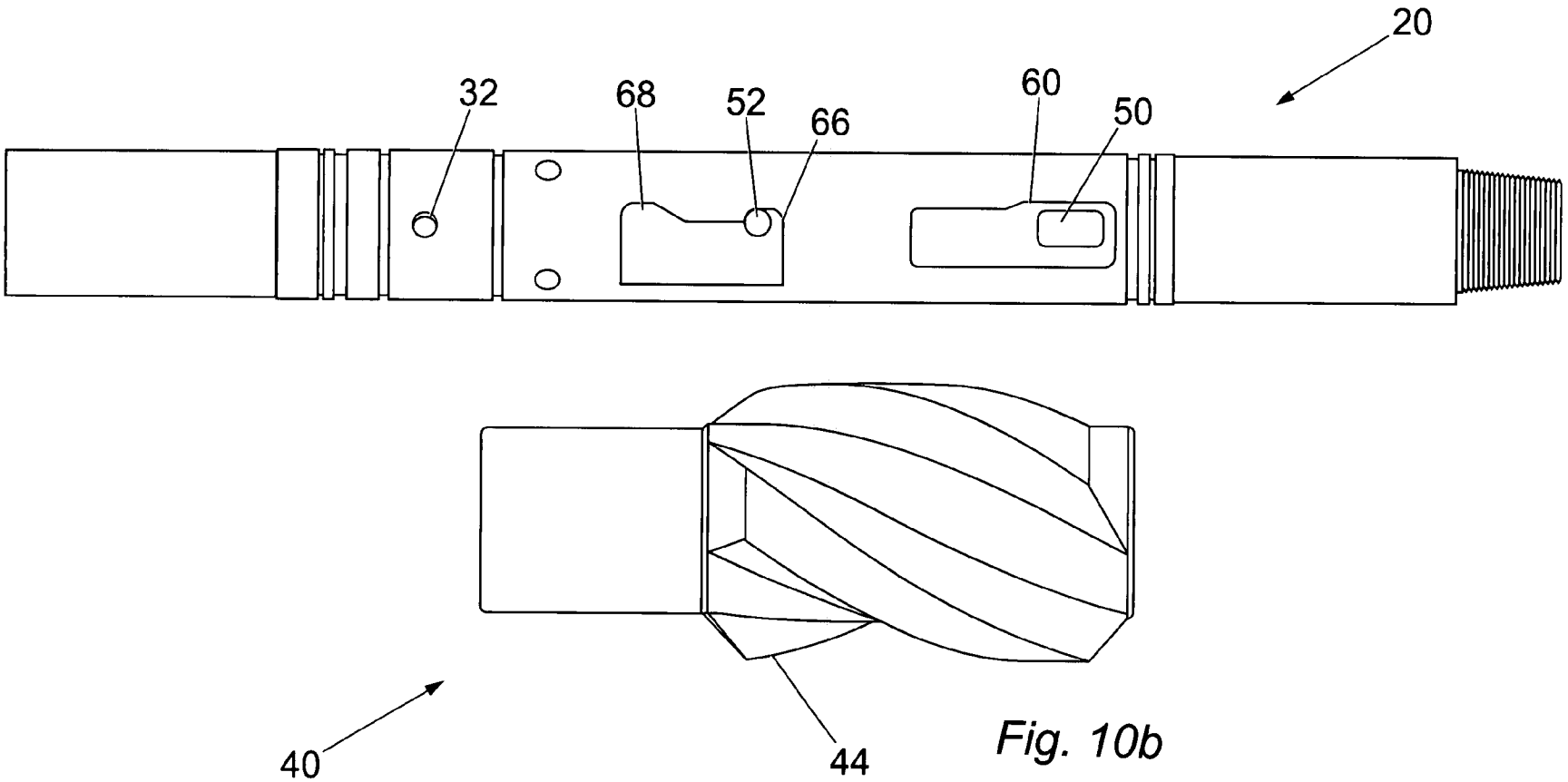
Figures 11A, 11B, 11C, 11D:
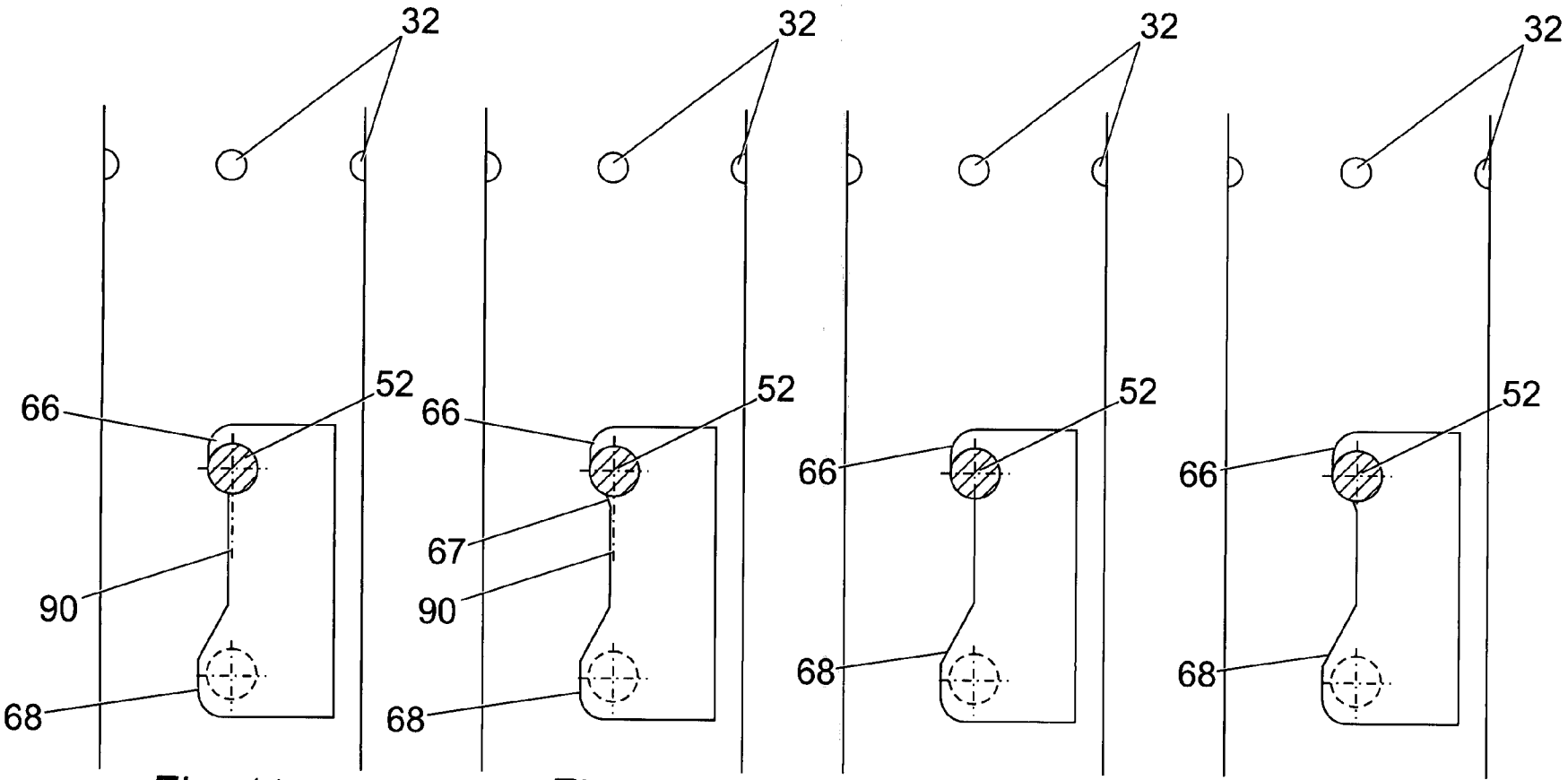

FIG. 8(*a*) to (*d*) are front and rear views of a portion of the tool of FIG. 5 with the sleeve at various positions;

FIGS. 9(*a*) and (*b*) is a perspective view of a tool according to a third embodiment of the invention with a portion of the sleeve removed for clarity and with the sleeve at a first and a second position respectively;

FIGS. 10(*a*) and (*b*) is a front view of the tool of FIG. 9 with the sleeve shown separately and with a lower portion of the tool rotated by 90° for clarity, and with the sleeve at a first and a second position respectively; and FIG. 11(*a*) to (*d*) are front views of variations of the pin and recesses of the tool of FIG. 9 with the sleeve removed for clarity.

Figure 1:
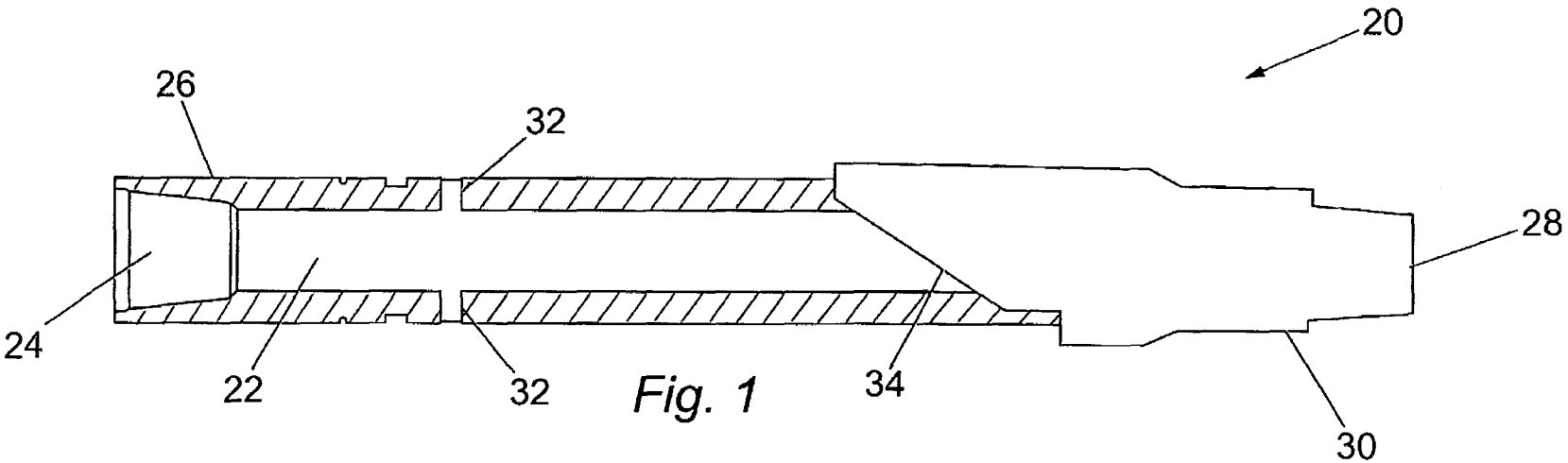
FIG. 1 is a sectional side view of the body of a tool according to a first embodiment of the invention.
Figure 2:
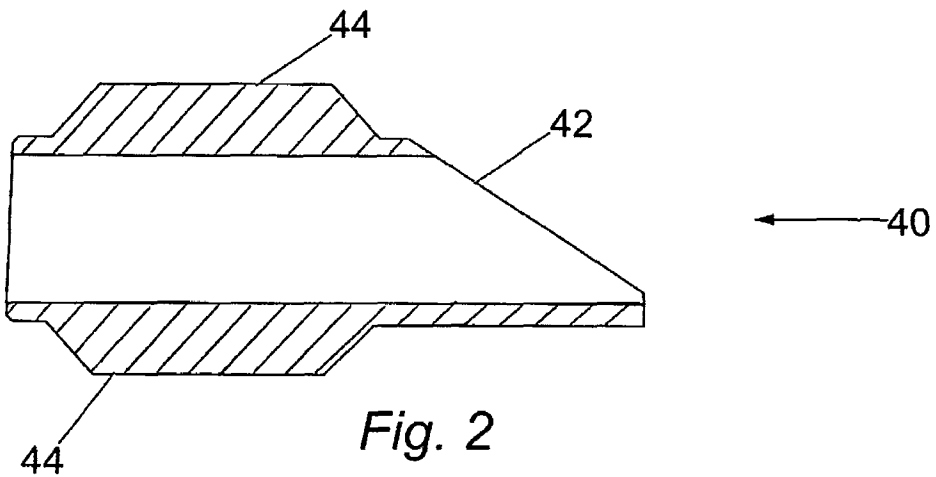
FIG. 2 is a sectional side view of a sleeve of a tool.

FIGS. 1 and 2 show the cylindrical body 20 and sleeve 40 of a downhole tool according to a first embodiment of the invention. The tool 10 is used as part of a drill string, and is typically located near to the bit of the drill string. The tool 10 includes connecting means in the form of screw fittings 38 for connection within the drill string.

Figure 3:
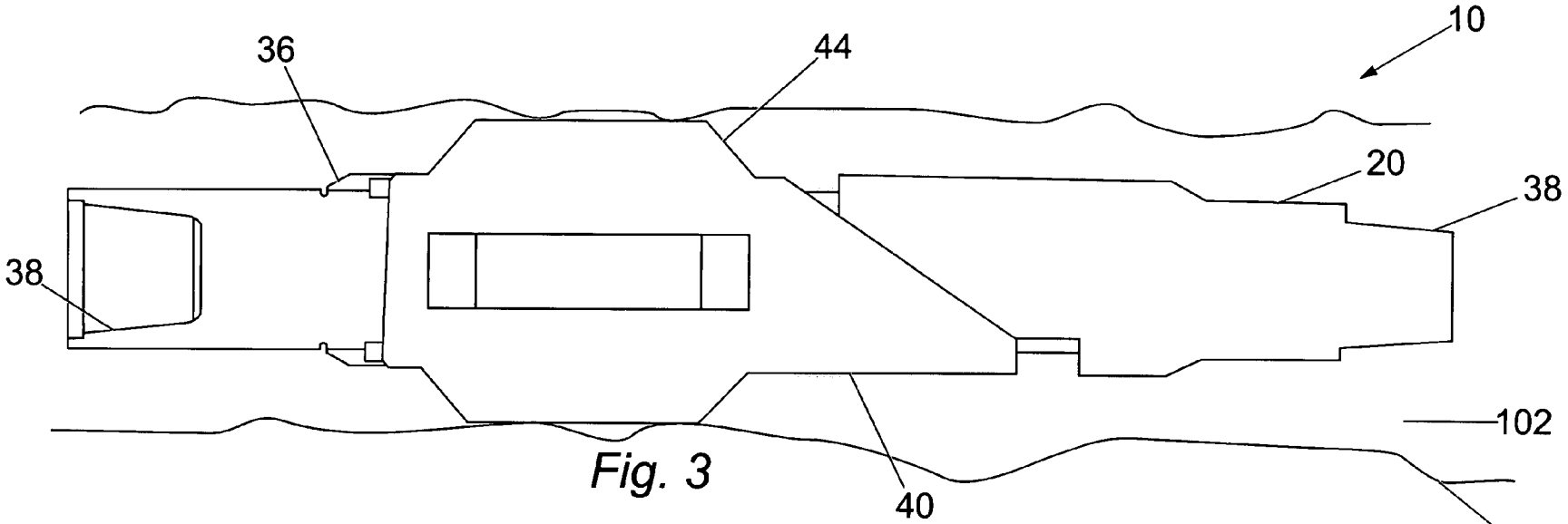
FIG. 3 is a side view of the sleeve of FIG. 2 mounted on the body of FIG. 1 with the sleeve in a first position.

As shown in FIG. 3, the body 20 has an external diameter which is smaller than the diameter of the well. There is therefore an annular gap 102 between the body 20 and the interior surface 100 of the well.

The body 20 includes a first downhole fluid passage 22 having an inlet 24 provided at an upper portion 26 of the body 20 and an outlet 28 provided at a lower portion 30 of the body 20. Four secondary fluid passages 32, which are arranged radially about the body 20, connect the first passage 22 and the annular gap 102. The body 20 includes a cam member 34.

Figure 4:
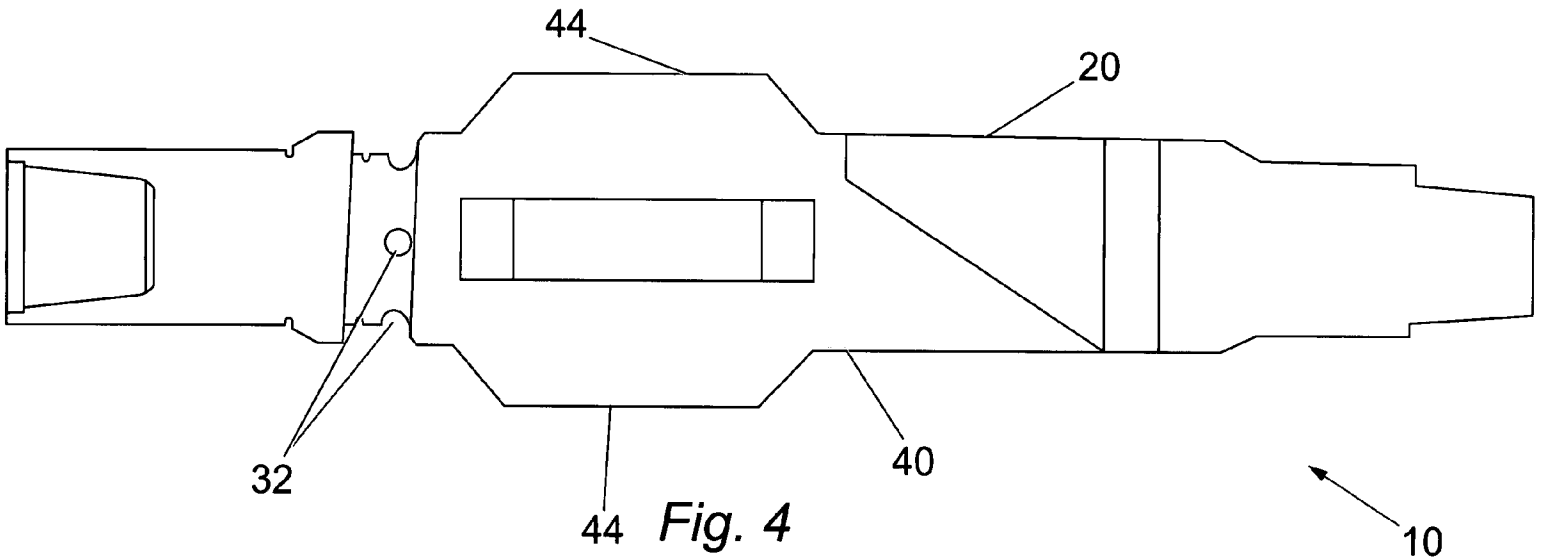
FIG. 4 is a side view of the tool of FIG. 3 with the sleeve in a second position.

The sleeve 40 is slidably and rotatably mounted externally to the body 20 as shown in FIGS. 3 and 4. However, in an alternative embodiment, at least a portion of the sleeve 40 may be internally mounted within the first passage 22. When the sleeve 40 is in a first position, as shown in FIG. 3, the secondary passages 32 are closed. When the sleeve 40 is at a second position, as shown in FIG. 4, the secondary passages 32 are open. The sleeve 40 includes a cam follower 42 for engagement with the cam member 34 of the body 20. For the embodiment of an internally mounted sleeve 40, the cam member 34 may be an inwardly projecting ledge.

A number of protrusions, or fins, or blades 44, extend from the body of the sleeve 40 for contacting the interior surface 100 of the well. When the tool 10 is being run into the well, frictional contact between the fins 44 and the well cause the sleeve 40 to be maintained at the first position.

During normal operation, rotation of the drill string causes the cam member 34 to act upon the cam follower 42 of the sleeve 40. Frictional contact of the fins 44 and the well tend to keep the sleeve 40 stationary, although there may be some rotational slippage. The angled contact surface of the cam member 34 and follower 42 result in an upwards lifting force being applied to the sleeve 40. The sleeve 40 moves upwards until it makes contact with a stop 36. Thereafter, the sleeve 40 is maintained against the stop 36 at the first position. The cam member 34 continues to exert a force on the follower 42, and so the sleeve 40 then rotates while at the first position. The rotation of the sleeve 40 is coupled to the rotation of the body 20.

The fins 44 provide a stabilising function to the tool 10 and thus the drill string.

When it is desired to run the tool 10 out of the well, the pumping pressure is removed and rotation of the drill string is ceased. The upwards lifting force from the cam member 34 is therefore removed. Due to the effects of both gravity and frictional contact between the fins 44 and the well, the sleeve 40 moves to the second position when the tool 10 is run out of the well. The secondary passages 32 therefore open and drilling fluid is free to pass through the secondary passages 32, as well as through the jets of the drill bit.

The drilling fluid may contain cuttings formed from the drilling process and it is desirable that these cuttings do not gain access to the jets of the drill bit where they may clog or damage the jets. Therefore, the diameter of the orifices of the secondary passages 32 may be less than the orifice diameter for the jets, and so any cuttings which may pass through the secondary passages to the jets will easily pass through the jets. If the diameter of the secondary passage orifices is too small, this can create an undesirable jetting effect. However, this can be overcome by using a larger number of secondary passages. A mesh (not shown) can also be provided in front of the jets to prevent access of cuttings. Another option is to use a valve (not shown) between the secondary passages 32 and the jets which is normally closed but which is opened by the pumping pressure during normal operation of the drill string.

FIGS. 5 to 8 show a second embodiment of the invention. Like elements are given like reference numerals.

In this embodiment, the co-operating engagement means comprises a substantially D shaped key member 50 and a first recess 60. The key member 50 has a semi-circular leading portion 52 and the first recess 60 has a complementary semi-circular profile.

During run in of the tool 10 in the well 100, frictional contact between the fins 44 and the surface of the well cause the sleeve 40 to move to the first position such that the secondary passages 32 are closed. At the first position of the sleeve 40, the key member 50 is horizontally aligned with the first recess 60. When the tool 10 is rotated in a clockwise direction, the leading portion 52 of the key member 50 locates within the first recess 60. As long as the body is rotated, the sleeve 40 is maintained at the first position. It is possible to lift the tool 10 while also rotating the tool 10, such as during back reaming. In this case, the sleeve 40 will remain at the first position while the tool 10 is being lifted within the well.

When it is desired to open the secondary passages 32 when lifting the tool 10 from the well, this can be achieved by simply ceasing rotation of the tool 10. In such a case, the effects of gravity and frictional contact with the well surface will cause the sleeve 40 to move to the second position. This is possible due to the particular profile of the key member 50 and first recess 60. The semi-circular profile is such that the sleeve 40 is only supported at the first position by a small upper portion of the key member 50. Without the maintaining force produced by rotation of the tool 10, lifting of the tool will cause the key member 50 to slip out of the first recess 50. To ensure that this happens, a relief portion 62 is provided at the first recess 62 adjacent to the position where the key member 50 vertically supports the sleeve 40. The relief portion 62 comprises a rounding or filleting of the corner of the first recess 60.

The sleeve 40 also includes a second recess 64 which is horizontally aligned with the key member 50 when the sleeve 40 is in the second position. By rotating the tool 10, the key member 50 will be received in the second recess 64 and this allows the sleeve 40 to be maintained at the second position, as long as the tool 10 is rotated. The second recess 64 also includes a relief portion 62.

FIGS. 9 to 11 show a third embodiment of the invention. Like elements are given like reference numerals.

In this embodiment, a rectangular shaped block 50 can be regarded to be the (first) key member. The co-operating engagement means also includes a second key member and a third recess 66. The second key member is a pin 52 which is fixed to the sleeve 44. The third recess 66 may be provided with a relief portion 67. The sleeve 44 is maintained at the second position when the pin 52 is located within the third recess 66.

The tool 10 also includes a fourth recess 68 for maintaining the sleeve 44 at the first position when the pin 52 is within the fourth recess 68.

The sleeve 44 houses the recesses and the key members to protect them from damage and to inhibit the ingress of solids.

In use, one but not both of the first and second key members bears the rotational load. When the tool 10 is run into the well, frictional contact between the sleeve 40 and the surface of the well causes the sleeve 40 to move to the first position such that the secondary passages 32 are closed. The block 50 is in contact with a vertical edge 67 of the tool body 20 while there is no contact between the pin 52 and recess 68. There is therefore no loading on the pin 52 when the tool 10 is rotated. Also, the geometry of the block 50 gives it a high strength and stiffness to bear the rotational load. However, it should be noted that, in this embodiment, there is no horizontal edge contact between the block 50 and tool body 20 to prevent vertical movement of the sleeve 40.

To overcome any axial slippage of the sleeve 40, locking means is provided to lock the sleeve 40 in the first position. The locking means comprises a number of pistons adapted to lock the sleeve 40 in the first position when activated by pumping pressure during normal operation of the drill string.

Opening of the secondary passages 32 when lifting the tool 10 from the well can be achieved by simply ceasing rotation of the tool 10. In such a case, the effects of gravity and frictional contact with the well surface will cause the sleeve 40 to move to the second position. This is possible since there is no horizontal edge contact between the block 50 and tool body 20.

The sleeve 40 can be maintained at the second position if the tool 10 is rotated when the pin 50 is horizontally aligned with the third recess 66. In this position, there is no contact between the block 50 and tool body 20.

The sleeve 40 is maintained at the second position when the rate of rotation is above a predetermined value, typically in the range of 20 to 40 revolutions per minute. The exact predetermined value may vary in use to some extent due to different well conditions. However, an approximate predetermined value, or value within a range, can be determined using a number of different parameters. These are: the presence or not of the relief portion 67, and the geometry of the relief portion 67, the third recess 66 and the pin 52. FIG. 11 shows variations of some of these parameters.

In FIG. 11(*a*), the third recess 66 has no relief portion. Consequently, a lower value of the rate of rotation is required to maintain the sleeve 40 at the second position. To counteract this to some extent, the geometry of the third recess 66 and the pin 52 are such that the centre of mass of the pin 52 is outside of the recess 66 by a certain distance 90. Therefore, a higher value of the rate of rotation is required to maintain the sleeve 40 at the second position and the distance 90 can be varied to achieve the desired predetermined value.

In FIG. 11(*b*), the third recess 66 has a relief portion 67. Therefore, a higher value of the rate of rotation is required to maintain the sleeve 40 at the second position than for the embodiment of FIG. 11(*a*).

In FIG. 11(*c*), the third recess 66 has no relief portion and is deeper such that the centre of mass of the pin 52 is aligned with an edge of the recess 66. This embodiment represents the lowest value of the rate of rotation required to maintain the sleeve 40 at the second position. Of course, an even lower value would be required if the recess 66 was made even deeper.

In FIG. 11(*d*), the third recess 66 has a relief portion 67 and a depth such that the centre of mass of the pin 52 is aligned with an edge of the recess 66.

Various modifications and improvements can be made without departing from the scope of the present invention. For example, the sleeve 40 may only be rotatably mounted on the body 20 and rotation of the body 20 causes rotation of the sleeve 40 to the first position. Biasing means may be provided to bias the sleeve 40 to one of the first and second positions.

The invention claimed is:

1. A downhole tool for use within a well having a diameter and an interior surface, the tool comprising:

a body having an external diameter smaller than the diameter of the well so as to form an annular gap between the body and the interior surface;

a first downhole fluid passage provided in the body and having an upper inlet and a lower outlet;

at least one secondary fluid passage provided at the body and extending between the first downhole fluid passage and the annular gap;

a sleeve member provided at the body and adapted to move between a first position in which said at least one secondary fluid passage is closed and a second position in which said at least one secondary fluid passage is open; and retention means comprising a co-operating engagement means having a first key member receivable within a first recess, the retention means being adapted to maintain the sleeve member at at least one of the first and second positions upon rotation of the body within the well when the rate of rotation is above a predetermined value.

2. A downhole tool as claimed in claim 1, wherein the predetermined value is in the range of 20 to 40 revolutions per minute.

3. A downhole tool as claimed in claim 1, wherein the engagement means comprises a cam member provided at the body and a cam follower provided at the sleeve.

4. A downhole tool as claimed in claim 1, wherein the retention means is adapted such that rotation of the body causes the sleeve member to move to, and thereafter be maintained at, the first position.

5. A downhole tool as claimed in claim 1, wherein the sleeve member is maintained at the first position when the key member is within the first recess.

6. A downhole tool as claimed in claim 5, wherein the first key member is horizontally aligned with the first recess when the sleeve member is at the first position.

7. A downhole tool as claimed in claim 5, wherein the key member and the first recess have a complementary profile.

8. A downhole tool as claimed in claim 1, wherein the co-operating engagement means includes a second recess, and wherein the sleeve member is maintained at the second position when the key member is within the second recess.

9. A downhole tool as claimed in claim 8, wherein the co-operating engagement means includes a second key member receivable within a third recess.

10. A downhole tool as claimed in claim 9, wherein the second key member comprises a pin provided at the sleeve member.

11. A downhole tool as claimed in claim 9, wherein the sleeve member is maintained at the second position when the second key member is within the third recess.

12. A downhole tool as claimed in claim 9, wherein the co-operating engagement means includes a fourth recess.

13. A downhole tool as claimed in claim 12, wherein at least on of the first to fourth recesses includes a relief portion.

14. A downhole tool as claimed in claim 9, wherein at least one of the recesses and the key members are provided at an internal surface of the sleeve member.

15. A downhole tool as claimed in claim 9, wherein the co-operating engagement means is arranged such that, in use, one but not both of the first and second key members bears a rotational load.

16. A downhole tool as claimed in claim 9, wherein the co-operating engagement means is adapted such that the sleeve member is maintained at at least one of the first and second positions when the rate of rotation is above a predetermined range of values.

17. A downhole tool as claimed in claim 16, wherein the predetermined range of values is at least partially determined by at least one of: the presence of a relief portion; the geometry of a relief portion; the geometry of one or more of the recesses; and the geometry of one or both of the key members.

18. A downhole tool as claimed in claim 1, including locking means for locking the sleeve member at one or both of the first and second positions.

19. A downhole tool as claimed in claim 18, wherein the locking means comprises at least one locking piston, and wherein at least one locking piston is actuatable by a fluid pumping pressure.

20. A downhole tool as claimed in claim 1, including at least one stop for preventing movement of the sleeve member beyond at least one of the first and second positions.

21. A downhole tool as claimed in claim 1, including at least one protrusion extending from the body of the sleeve member and contacting the interior surface such that frictional contact between the at least one protrusion and the well causes the sleeve member to be urged to the first position when the tool moves downwardly relative to the well.

22. A downhole tool for use within a well having a diameter and an interior surface, the tool comprising:

a body having an external diameter smaller than the diameter of the well so as to form an annular gap between the body and the interior surface;

a first downhole fluid passage provided in the body and having an upper inlet and a lower outlet;

at least one secondary fluid passage provided at the body and extending between the first downhole fluid passage and the annular gap;

a sleeve member provided at the body and adapted to move between a first position in which said at least one secondary fluid passage is closed and a second position in which said at least one secondary fluid passage is open; and retention means which maintains the sleeve member at at least one of the first and second positions upon rotation of the body within the well, the retention means comprising a co-operating engagement means having a first key member and a second key member, wherein the first key member is receivable within a first recess to maintain the sleeve member in the first position, wherein the first key member is receivable within a second recess to maintain the sleeve member in the second position, and wherein the second key member is receivable within a third recess.

23. A downhole tool as claimed in claim 22, wherein the second key member comprises a pin provided at the sleeve member.

24. A downhole tool as claimed in claim 22, wherein the sleeve member is maintained at the second position when the second key member is within the third recess.

25. A downhole tool as claimed in claim 22, wherein the co-operating engagement means includes a fourth recess.

26. A downhole tool as claimed in claim 25, wherein at least one of the first to fourth recesses includes a relief portion.

27. A downhole tool as claimed in claim 22, wherein at least one of the recesses and the key members are provided at an internal surface of the sleeve member.

28. A downhole tool as claimed in claim 22, wherein the co-operating engagement means is arranged such that, in use, one but not both of the first and second key members bears a rotational load.

29. A downhole tool as claimed in claim 22, wherein the co-operating engagement means is adapted such that the sleeve member is maintained at at least one of the first and second positions when the rate of rotation is above a predetermined range of values.

30. A downhole tool as claimed in claim 29, wherein the predetermined range of values is at least partially determined by at least one of: the presence of a relief portion; the geometry of a relief portion; the geometry of one or more of the recesses; and the geometry of one or both of the key members.

31. A downhole tool for use within a well having a diameter and an interior surface, the tool comprising:

a body having an external diameter smaller than the diameter of the well so as to form an annular gap between the body and the interior surface;

a first downhole fluid passage provided in the body and having an upper inlet and a lower outlet;

at least one secondary fluid passage provided at the body and extending between the first downhole fluid passage and the annular gap;

a sleeve member provided at the body and adapted to move between a first position in which said at least one secondary fluid passage is closed and a second position in which said at least one secondary fluid passage is open;

retention means adapted such that rotation of the body causes the sleeve member to move to, and thereafter be maintained at, at least on of the first and second positions; and locking means for locking the sleeve member at one or both of the first and second positions, wherein the locking means comprises at least one locking piston actuatable by a fluid pumping pressure.

32. A downhole tool as claimed in claim 31, wherein the retention means is adapted to maintain the sleeve member at at least one of the first and second positions when the rate of rotation is above a predetermined value.

33. A downhole tool as claimed in claim 32, wherein the predetermined value is in the range of 20 to 40 revolutions per minute.

34. A downhole tool as claimed in claim 31, wherein the body and the sleeve member have co-operating engagement means for maintaining the sleeve member at at least one of the first and second positions.

35. A downhole tool as claimed in claim 34, wherein the engagement means comprises a cam member provided at the body and a cam follower provided at the sleeve.

36. A downhole tool as claimed in claim 31, wherein the retention means is adapted such that rotation of the body causes the sleeve member to move to, and thereafter be maintained at, the first position.

37. A downhole tool as claimed in claim 34, wherein the co-operating engagement means comprises a first key member.

38. A downhole tool as claimed in claim 37, wherein the first key member is receivable within a first recess, and wherein the sleeve member is maintained at the first position when the key member is within the first recess.

39. A downhole tool as claimed in claim 38, wherein the first key member is horizontally aligned with the first recess when the sleeve member is at the first position.

40. A downhole tool as claimed in claim 38, wherein the key member and the first recess have a complementary profile.

41. A downhole tool as claimed in claim 37, wherein the co-operating engagement means includes a second recess, and wherein the sleeve member is maintained at the second position when the key member is within the second recess.

42. A downhole tool as claimed in claim 41, wherein the co-operating engagement means includes a second key member receivable within a third recess.

43. A downhole tool as claimed in claim 42, wherein the second key member comprises a pin provided at the sleeve member.

44. A downhole tool as claimed in claim 42, wherein the sleeve member is maintained at the second position when the second key member is within the third recess.

45. A downhole tool as claimed in claim 42, wherein the co-operating engagement means includes a fourth recess.

46. A downhole tool as claimed in claim 45, wherein at least on of the first to fourth recesses includes a relief portion.

47. A downhole tool as claimed in claim 42, wherein at least one of the recesses and the key members are provided at an internal surface of the sleeve member.

48. A downhole tool as claimed in claim 42, wherein the co-operating engagement means is arranged such that, in use, one but not both of the first and second key members bears a rotational load.

49. A downhole tool as claimed in claim 42, wherein the co-operating engagement means is adapted such that the sleeve member is maintained at at least one of the first and second positions when the rate of rotation is above a predetermined range of values.

50. A downhole tool as claimed in claim 49, wherein the predetermined range of values is at least partially determined by at least one of: the presence of a relief portion; the geometry of a relief portion; the geometry of one or more of the recesses; and the geometry of one or both of the key members.

51. A downhole tool as claimed in claim 31, including at least one stop for preventing movement of the sleeve member beyond at least one of the first and second positions.

52. A downhole tool as claimed in claim 31, including at least one protrusion extending from the body of the sleeve member and contacting the interior surface such that frictional contact between the at least one protrusion and the well causes the sleeve member to be urged to the first position when the tool moves downwardly relative to the well.

* * * * *

UNITED STATES PATENT AND TRADEMARK OFFICE

CERTIFICATE OF CORRECTION

PATENT NO. : 7,350,598 B2
APPLICATION NO. : 11/182441
DATED : April 1, 2008
INVENTOR(S) : Richard Keith Booth It is certified that error appears in the above-identified patent and that said Letters Patent is hereby corrected as shown below:

On the Title Page, Item (73)
Assignee name is listed as:

Hamdeem Incorporated Limited

It should be:

Hamdeen Incorporated Limited.

Signed and Sealed this

Twenty-second Day of July, 2008

JON W. DUDAS
*Director of the United States Patent and Trademark Office*